US005779001A

United States Patent [19]

Skyba

[11] Patent Number: 5,779,001

[45] Date of Patent: Jul. 14, 1998

[54] FOLDING LADDER, TREE STAND AND SECURING DEVICE THEREFOR

[76] Inventor: Helmut K. Skyba, Rte. 2, Box 330, Wild Rose, Wis. 54984

[21] Appl. No.: 909,622

[22] Filed: Aug. 12, 1997

Related U.S. Application Data

[62] Division of Ser. No. 365,835, Dec. 29, 1994, Pat. No. 5,655,623.

[51] Int. Cl.[6] ..... B66F 3/00

[52] U.S. Cl. ..... 182/107; 24/68 CD

[58] Field of Search ..... 182/116, 93, 107, 182/129; 24/170, 70 ST, 69 ST, 69 CT, 69 TM, 71 ST, 71 TD, 68 D, 68 BT, 68 CD

[56] References Cited

U.S. PATENT DOCUMENTS

| | | | |
|---|---|---|---|
| 159,126 | 1/1875 | VanZandt . | |
| 1,142,072 | 6/1915 | Wingerd . | |
| 2,191,228 | 2/1940 | Dowd | 24/170 |
| 3,216,526 | 11/1965 | Cole . | |
| 3,493,079 | 2/1970 | Dudschus . | |
| 3,826,473 | 7/1974 | Huber | 24/68 CD |
| 3,995,714 | 12/1976 | Brookes et al. . | |
| 4,199,182 | 4/1980 | Sunesson | 24/68 CD |
| 4,467,890 | 8/1984 | McCallum et al. . | |
| 4,542,805 | 9/1985 | Hamlin et al. . | |
| 4,643,274 | 2/1987 | Tataseo . | |
| 4,706,780 | 11/1987 | Ohashi | 182/93 |
| 4,722,420 | 2/1988 | Arthurs et al. . | |
| 4,787,476 | 11/1988 | Lee . | |
| 4,792,016 | 12/1988 | Ingalsbe | 182/107 |
| 4,809,953 | 3/1989 | Kurita | 24/68 CD |
| 5,109,954 | 5/1992 | Skyba . | |
| 5,242,030 | 9/1993 | Lobozzo . | |

FOREIGN PATENT DOCUMENTS

| | | |
|---|---|---|
| 1292369 | 7/1969 | Germany . |
| 2137681 | 10/1984 | United Kingdom . |

*Primary Examiner*—Alvin C. Chin-Shue
*Attorney, Agent, or Firm*—Ryan, Maki, Mann & Hohenfeldt

[57] ABSTRACT

A ladder having pivotable folding riser sections, includes at least one pair of elongated riser components connected by a folding joint. The components have mating contacting ends abutting each other at an angle 45° from the linear axis of the components. A reinforcing member concentric with said components is positioned across the joint, and a pivotable connection is formed by hinge members connected to each of the ladder components which are pivotally connected to each other by means of a hinge pin located exteriorally of the components. The invention also provides pivoting stand off members and a strap tightening mechanism for providing tightening tension equally on both ends of the strap which thus is not caused to move laterally during tightening.

2 Claims, 8 Drawing Sheets

10
12
14
16
17
18
19A
20
22
24
26
28
30
32
40
42
43
44
45
46
48
49
50
54

112
118
122
116
124
122
117
116
114

123
112
118
115
124
114
117
120
122

112
122
120
118
117
115
114

112
120
118
122
117
116
114

FOLDING LADDER, TREE STAND AND SECURING DEVICE THEREFOR

This is a divisional of application Ser. No. 08/365,835 filed on Dec. 29, 1994, U.S. Pat. No. 5,695,623, issued Aug. 12, 1997.

FIELD OF THE INVENTION

This invention relates generally to folding ladders. More specifically, the invention relates to folding ladders and ladder/tree stand combinations particularly adapted to be attached to an upright structure, such as a tree or pole, and useful for hunting in wooded areas, and components thereof as well as relating devices for securing the ladders to vertical structures.

BACKGROUND OF THE INVENTION

Various types of ladder and ladder/tree stand combinations have been used heretofore by hunters. Also, ladders or climbing sticks are useful for sportsmen to gain access to the upper reaches of a tree or for access to a pole by maintenance workers or for climbing vertical structures by military personnel, fire fighters, etc. One example of a single pole ladder is set forth in my U.S. Pat. No. 5,109,954, issued May 5, 1992.

An individual placing a double pole ladder against an irregular vertical structure, such as a tree or pole faces several difficulties. First, varied or uneven ground makes it difficult to support both risers of the ladder in a level orientation. Secondly, the tree or other structure can compound the danger due to the fact that it presents a round surface at the top of the ladder which forms the other point of contact required to keep the ladder in an upright position. These factors increase the danger of the ladder tipping or rotating to the side and result in numerous injuries. Some ladder/tree stand combinations provide a platform at the top of the ladder, between the ladder and the tree. This type of structure, however, increases the danger because the ladder is spaced an additional 20–30 inches away from the tree or structure. In order to provide a stable ladder, the lower end of the ladder must be a minimum of 4–5 feet away from the tree, which makes it almost impossible to secure the ladder against the tree with tie-offs while the user is still on the ground. Only when the person has reached the top platform, can the ladder be secured to the tree with a strap or cord.

A need has thus existed for improved ladder configurations having either one or two risers. A need has also existed for improved joints for connecting sections of folding ladders for such uses as well as ratchet mechanisms for attaching such ladders securely to vertical structures. Also, a need has existed for providing stand off mechanisms that either pivot out of the way for transportation, or which can be pivoted into various positions for supporting the ladder, or both.

SUMMARY OF THE INVENTION

It is a principal object of the invention to provide improved ladder configurations having either single or double risers. In accordance with an important aspect of the invention, an improved pivoting joint construction is provided for such ladders which provide stability and strength in the joint area, rivaling that of an intact riser structure.

In accordance with another aspect of the invention, improved configurations for pivoting stand off devices for spacing such ladders away from the vertical structure which the ladder is attached are provided. In accordance with a yet related aspect of the invention, an improved strap ratchet system is provided for mounting the ladders onto a vertical structure such as a tree or pole.

In accordance with further aspects of the invention, the ladders of the present invention are adapted to be securely mounted to a tree or other vertical structure and, thus will support weight placed on a step extending to the side of the ladder, for example an outwardly pivoting cleat, which provides access to a stand at the top of the ladder. Such a stand can also be pivotally attached to the ladder so that it can be folded compactly for transportation or storage.

In accordance with a still further aspect of the invention, a belt for tightening the ladder to the tree is provided, which belt has a ratchet mechanism adapted to equally tighten both sides of the belt so that the ladder does not move on the tree during tightening or loosening of the belt.

In accordance with yet another aspect of the invention, the ladder is configured to unfold while it is being erected against a vertical structure.

In accordance with yet further aspects of the invention, a joint configuration between folding sections is provided wherein the tube ends are cut at a 45° angle and provided with a concentric reinforcing section at the joint position, either inside or outside of the tube. In accordance with a related aspect, a joint for folding sections of a ladder riser are provided which is substantially stiffer and stronger than a butt joint.

Briefly, the invention provides a ladder having pivotable folding riser sections, includes at least one pair of elongated riser components connected by a folding joint. The components have mating contacting ends abutting each other at an angle 45° from the linear axis of the components. A reinforcing member concentric with said components is positioned across the joint, and a pivotable connection is formed by hinge members connected to each of the ladder components which are pivotally connected to each other by means of a hinge pin located exteriorally of the components. The invention also provides pivoting stand off members and a strap tightening mechanism for providing tightening tension equally on both ends of the strap which thus is not caused to move laterally during tightening.

Other features and advantages of the invention will be set forth and become apparent from the specification and claims and accompanying drawings wherein:

BRIEF DESCRIPTION OF THE DRAWINGS

FIG. 20 is a side elevational view showing a further embodiment of the device of FIGS. 12–15.

DETAILED DESCRIPTION OF PREFERRED EMBODIMENTS

Figure 1:
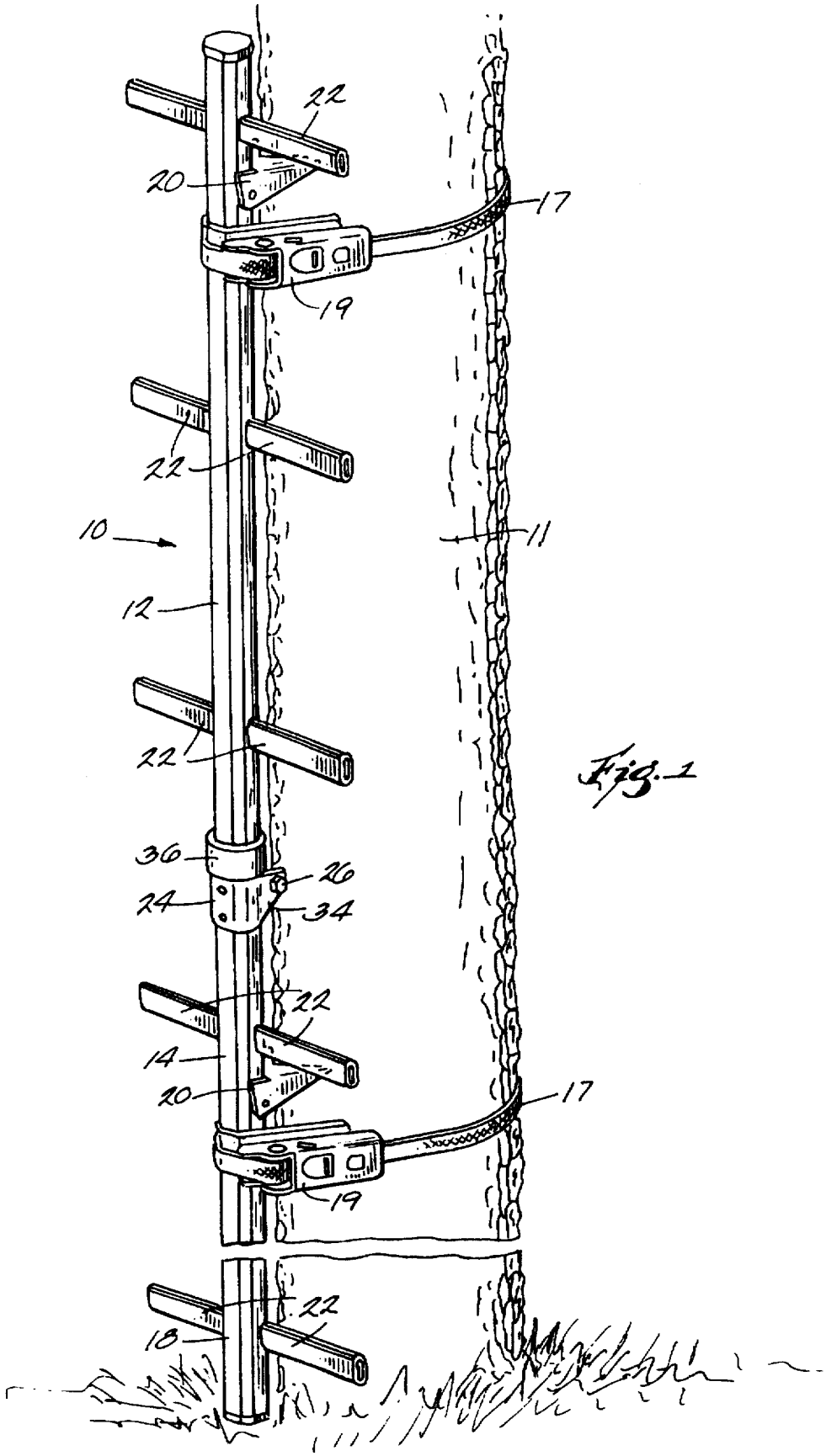
FIG. 1 is a perspective view of a single riser ladder in accordance with the invention secured to the trunk of a tree.

Referring more particularly to FIG. 1, there is seen a ladder 10 utilizing a single riser consisting of a series of folding sections 12, 14, 16 and 18. The ladder 10 is attached to a tree or similar vertical structure 11 by means of straps 17 that are tightened by means of a ratchet mechanism 19. Ladder 10 is maintained in an orientation parallel to and spaced from the trunk of tree 11 by means of stand off members 20 which are pivotally attached to the riser sections of ladder 10. Extending laterally from each side of the riser sections of ladder 10 are a plurality of steps 22 provided to enable climbing of the ladder.

Figures 2, 2A:
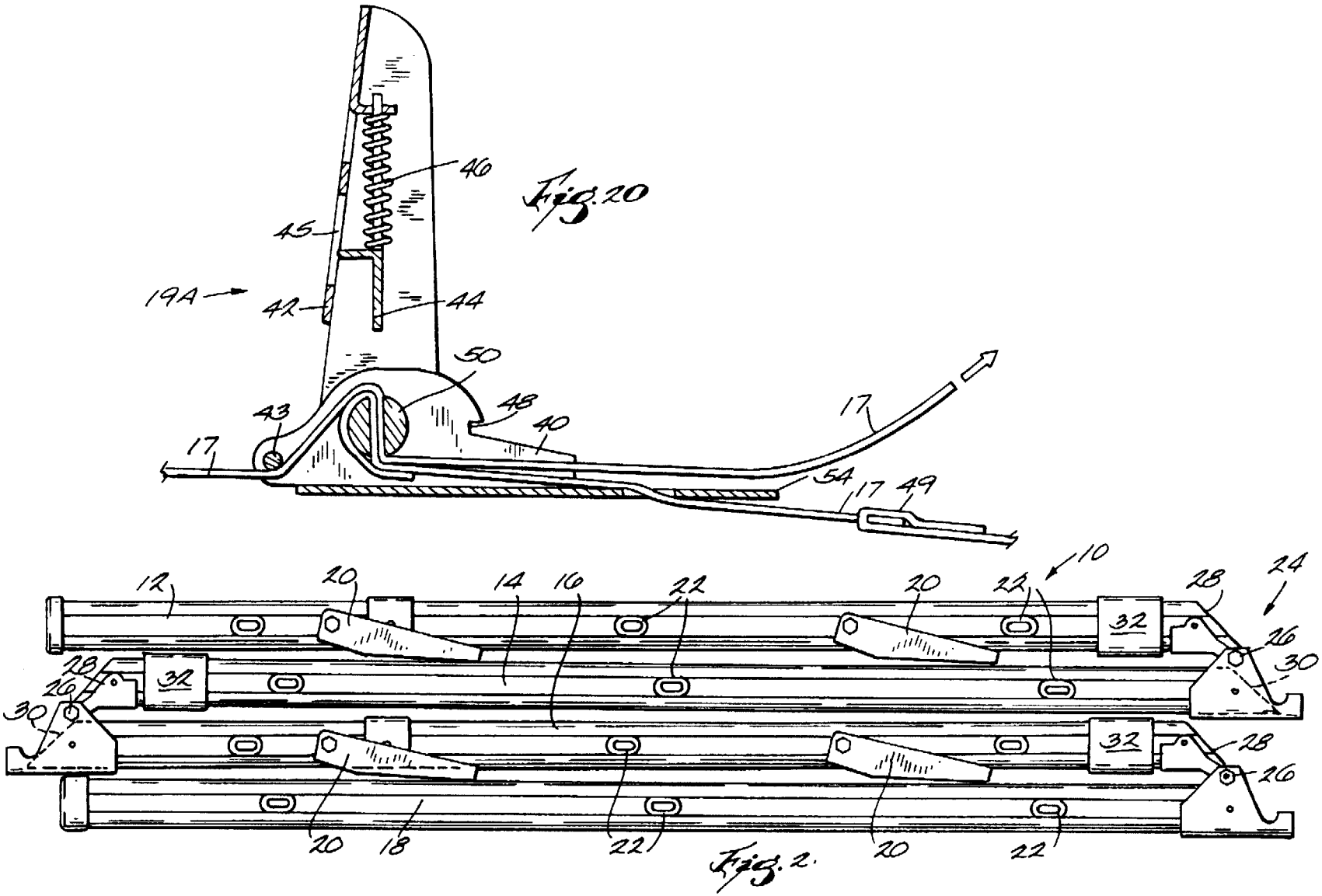
FIG. 2 is a side elevational view of the ladder of FIG. 1 folded into a compact position for transportation or storage.
Figure 3:
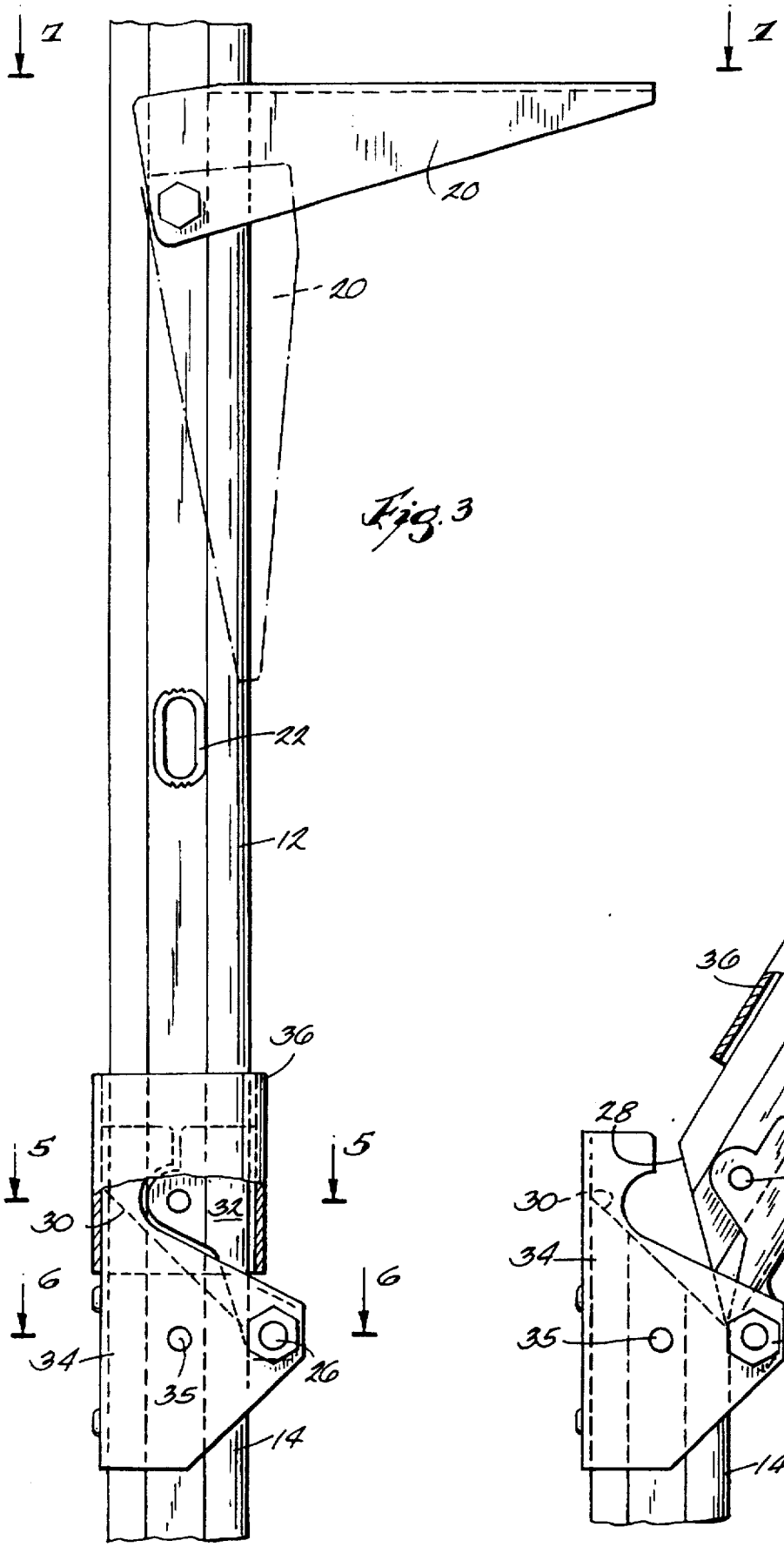
FIG. 3 is an enlarged view of the fragmentary portion of the ladder of FIG. 1 with hidden parts shown by phantom lines.

Sections 12, 14, 16 and 18 are pivotally attached to each other by means of pivoting joints 24 which connect the sections pivotally on pin 26 which is positioned outwardly from the riser sections. Ladder 10 is seen in the folded or collapsed position in FIG. 2. Also, as seen in FIG. 2, the pivotable stand off members 20 are formed in a general U-shape so that the base of the "U" can fold compactly against the riser sections 12, 14, 16 and 18. Referring to FIG. 3, the extended and folded orientations of stand off member 20 are shown.

Figure 4:
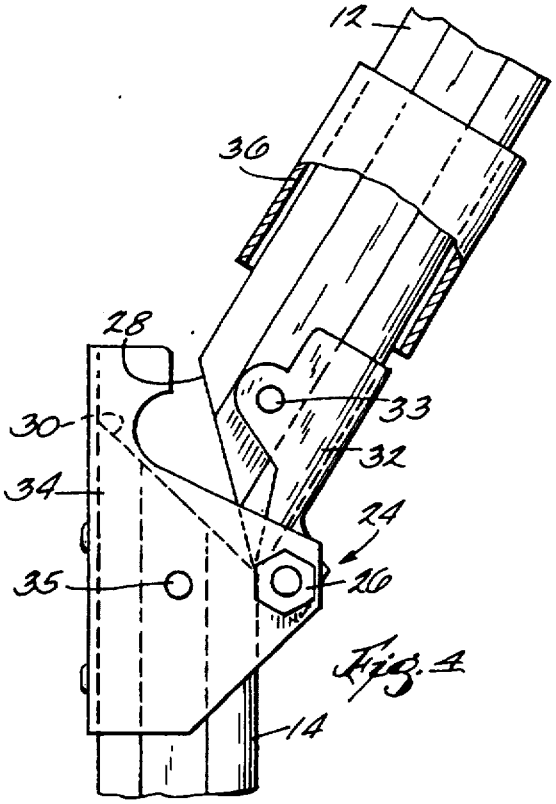
FIG. 4 is a fragmentary view of the ladder of FIG. 3 joint in a partially pivoted orientation.

The details of hinge mechanism 24 are best seen in FIGS. 3 and 4. It will be noted that the ends of hollow tubular sections 12 and 14 are cut along 45° angled lines 28 and 30 which abuttingly fit together when the ladder is extended as seen in FIG. 3. Hinge members 32 and 34 together form an encircling tubular structure concentric with and circumscribing the joint area 24 between members 12 and 14. Hinge members 32 and 34 are pinned or riveted to the respective tubular members 12 and 14 by means of, for example, rivets 33 and 35, respectively. These sections pivot around pin or bolt 26 which is positioned outside of the profile of members 12 and 14 which, thus, are able to pivot away from each other as seen in FIG. 4 and allow the ladder sections to be compactly folded to the configuration shown in FIG. 2. A concentrically mounted sleeve 36 is sized to slide over the exterior of hinge members 32 and 34, thus forming an assembly wherein hinge area 24 is reinforced by a concentric outer encircling structure. In accordance with the invention, it has been found that the 45° cut along the intersection of the members 12 and 14 together with the concentric reinforcing structure provides an exceptionally strong and stable joint between the sections of the ladder 10. The reference to the joint between sections 12 and 14 is shown as an example of the joint configuration, the pivoting joints between the other members being similar. Thus it will be appreciated that similar jointed connections are provided between members 14 and 16 and members 16 and 18. Additionally, if a taller ladder structure is desired, additional pivoting sections can be added.

Figure 7:
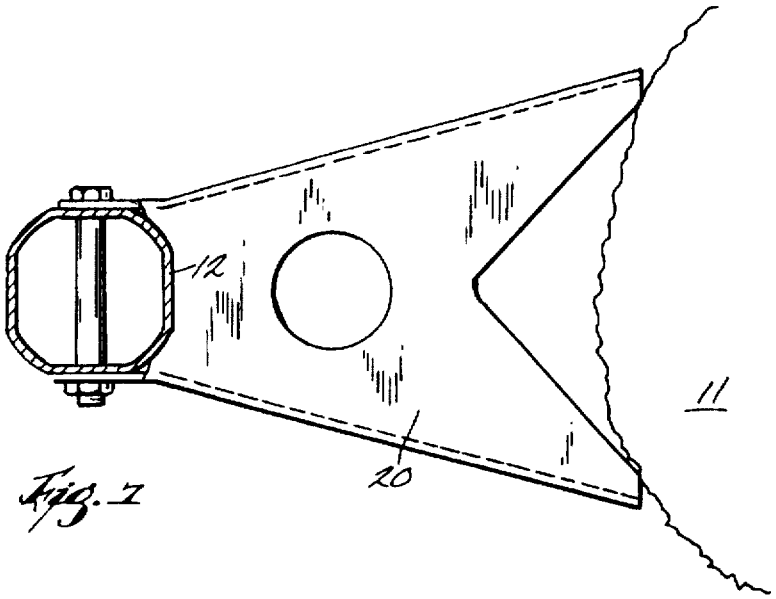
FIG. 7 is a sectional view taken along line 7—7 of FIG. 3.
Figure 6:
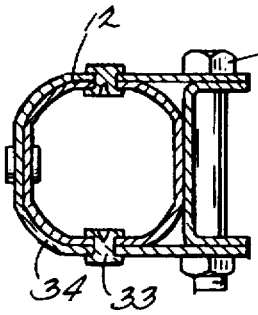
FIG. 6 is a sectional view taken along line 6—6 of FIG. 3.
Figure 5:
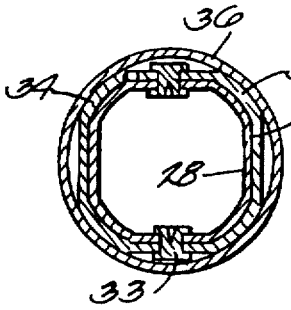
FIG. 5 is a sectional view taken along line 5—5 of FIG. 3.
Figure 12:
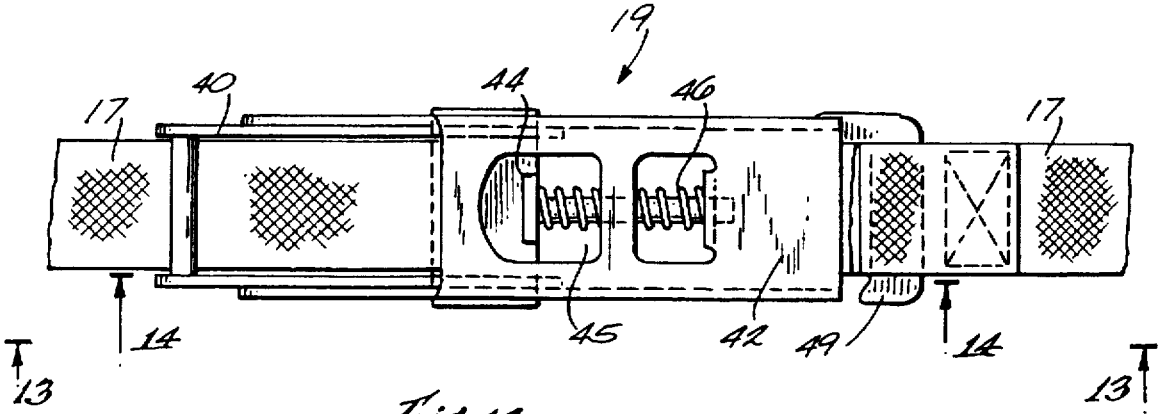
FIG. 12 is a fragmentary top plan view of a strap-tightening ratchet in accordance with the invention.

As best seen in FIGS. 5–7, the ladder riser segments 12–18 are hollow, but rather than being round in cross-section, the sections are octagonal in the illustrated embodiment. The octagonal cross-section provides strength against crushing or twisting while still providing flat surfaces for attachment thereto of pivoting members as seen in the drawings. Other cross-sections such as circular, square, etc. can be substituted, however, if desired.

Figures 8, 9, 10, 11:
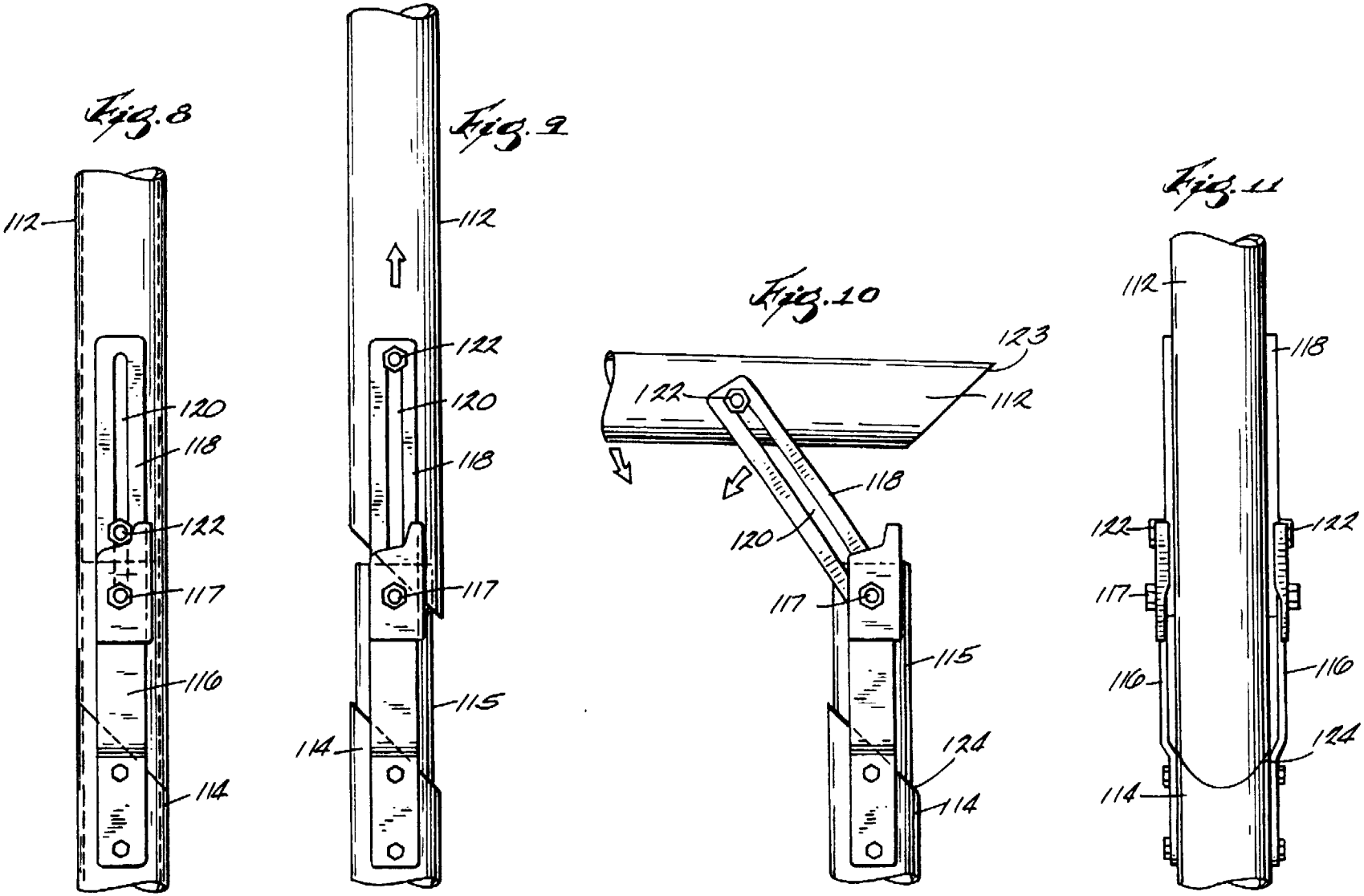
FIG. 8 is a fragmentary side elevational view showing an alternate embodiment of a joint for connecting sections of a ladder in accordance with the invention.
FIG. 9 is a fragmentary view of the section of FIG. 8 showing the components in a separated position.
FIG. 10 is a side view of the mechanism shown in FIG. 9 when it is being pivoted to an open position.
FIG. 11 is a side view of the section of FIG. 8.

Referring to FIGS. 8–11, there is seen an alternative structure for a pivoting, jointed connection between two tubular structural members 112 and 114 which can be used as a part of the ladder of this invention. In the embodiment of FIGS. 8–11, a concentric reinforcing tube 115 is placed within and bridging the interiors of the tubular members 112 and 114 in the area of the jointed connection shown. In this embodiment, a hinged connection is provided by the illustrated apparatus which includes a bracket 116 on each side of one of the tubular members 114 to which it is secured by means of bolts. As best seen in FIG. 11, brackets 116 together form a yolk structure around the joint area. The upper ends of the yolk formed by bracket members 116 are provided with a pin or bolt 117 which pivotally connects slotted members 118 to the upper end of yolk brackets 116 so that the members can pivot as shown in FIG. 10. Bracket 118 has an elongated central slot 120 which slidably receives another pin or bolt 122 that connects the hinge structure to tubular member 112. The resultant joint structure 124 also entails the adjoining structures of tubes 112 and 114 being cut so that they abut at a 45° angle as seen in FIGS. 8 and 11. The combination of the angular abutment with central concentric reinforcing tube 115 provides an exceptionally stable joint construction 124 similar in strength to joint 24 described herein above. The configuration also provides a self-locating feature by virtue of the fact that when the sections are pushed together a small point first engages the reinforcing tube so that correct positioning is facilitated. Also, the yoke, in addition to limiting movement of the tube sections away from each other, serves as a centering guide for correct movement of the sections. Thus the usual difficulty encountered in connecting telescoping tubular sections is overcome.

Referring to FIGS. 12–15, the details of strap tightener mechanism 19 are revealed in greater detail. Mechanism 19 includes a base portion 40 and a handle portion 42 that is hinged to base portion 40 by means of a pivot pin 43. Handle 42 includes a slidable lock 44 that is biased toward the closed position extended downwardly in FIG. 15 so that it will engage a pair of notches 48 in base 40 when the handle is in the closed position seen in FIGS. 13 and 14. An opening 45 in handle 42 allows access to lock 44 so that the bias of spring 46 can be manually overcome in order to release handle 42 thereby allowing it to pivot open to the position of FIG. 15.

Figure 13:
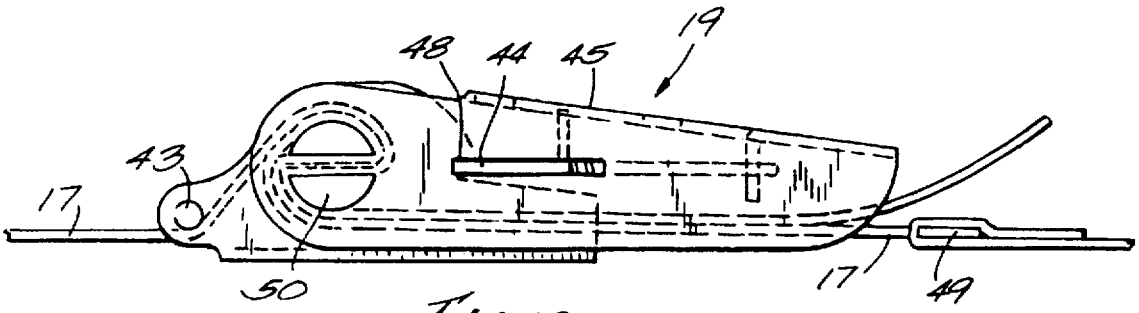
FIG. 13 is a side elevational view of the ratchet of FIG. 12, taken along line 13—13.
Figure 14:
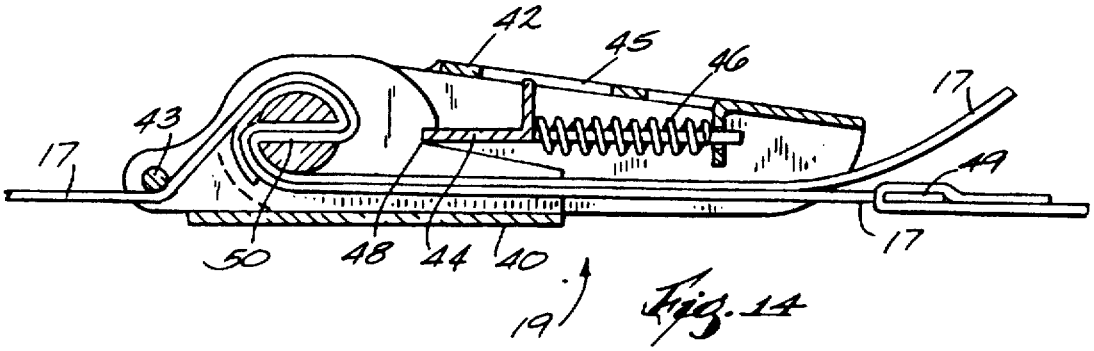
FIG. 14 is a sectional view of the mechanism of FIG. 12 taken along line 14—14.
Figure 15:
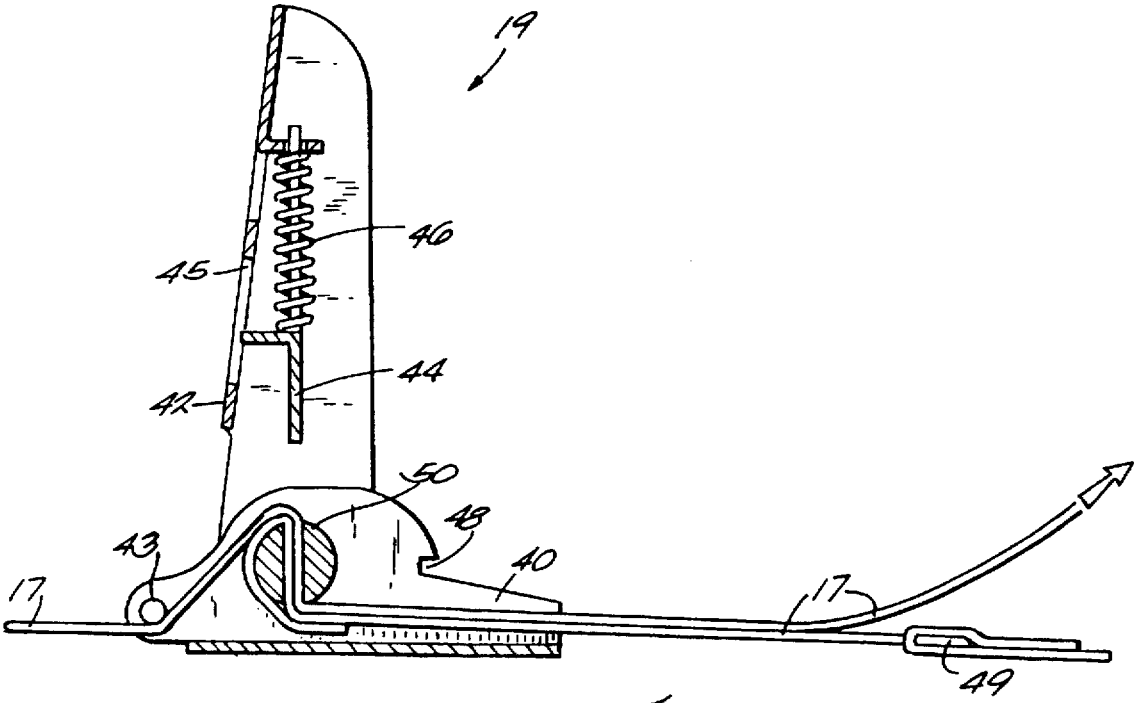
FIG. 15 is a sectional view showing the mechanism of FIG. 14 in a pivoted position.

Integral with handle 42 is a slotted pin 50 which has a transverse central slot as best seen in FIGS. 13–15. The slot is dimensioned to accommodate both ends of strap 17. One end of strap 17 is wrapped through the slotted pin around one side thereof so this end is tightened when the handle 42 is pivoted to the closed position of FIGS. 13 and 14. The central slot of pin 50 also accommodates the other end of strap 17 which after installation of the ladder around the vertical structure is pulled manually to the tightest attainable tension. Then, when handle 42 is pivoted from the open position of FIG. 15 to the closed position of FIGS. 13 and 14, both ends of strap 17 are pulled toward slotted end 50. Thus, the tightening of strap 17 does not tend to pull the ladder over toward either side, but rather uniformly applies substantial tension to both ends of belt 17, thereby securing the ladder 10 to a tree or other vertical structure.

A hook 49 can be placed at one end of a belt section, if desired for reasons of convenience. Referring to FIG. 20, a slot 52 can be provided in base 40. Such a slot is important for use in cases when the tightening mechanism 19A is used in the absence of a backing structure such as a tree or pole which prevents rotation of base 40 when the handle 45 is tightened. This resistive action is provided by the fact that end 54 of base 40 that ends beyond slot 52 engages the top of belt 17, thereby preventing rotation of base 40.

Referring to FIGS. 16–19, there is seen a double riser ladder 60 wherein a series of rungs 61 connect pivoting riser sections 62, 63, 64, 65, 66, 67, 68 and 69. As in the case of the single riser ladder shown in FIG. 1, a pivoting joint 24 is provided to allow pivoting of adjacent sections and, thus, folding of the ladder into the compact orientation shown in FIG. 17.

Figure 19:
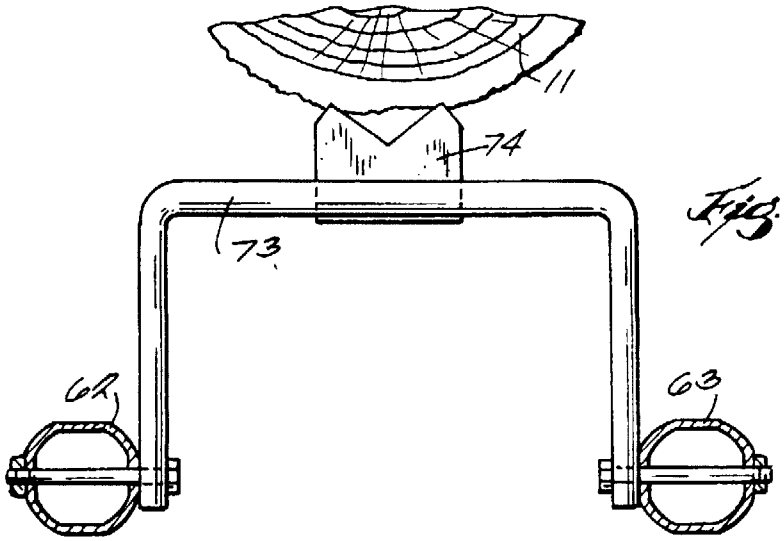
FIG. 19 is a sectional view taken along line 19—19 of FIG. 18.
Figure 18:
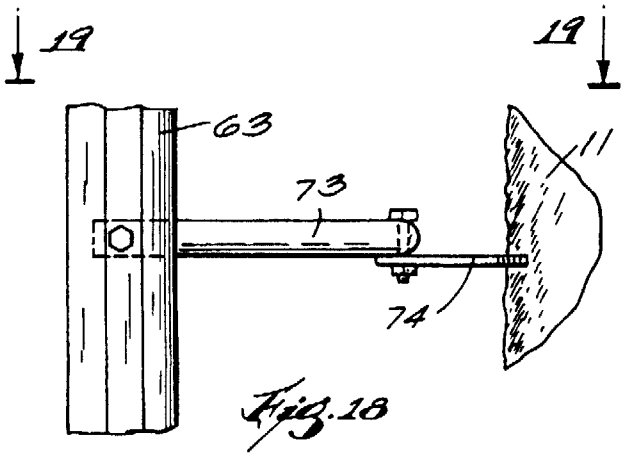
FIG. 18 is a fragmentary side view showing a stand off device in accordance with the ladder of FIG. 16.

The illustrated embodiment shows a ladder intended for use as a ladder/tree stand combination. In this case, a U-shaped top 70 which supports a seat 72 is attached to the ladder. A side-to-side pivoting stand off member 74 is pivotally attached by means of a vertical pivot pin to U-shaped member 70. A series of U-shaped members 73 can be provided with similar pivoting stand off members 74 to position the entire length of the ladder at a desired distance away from the tree when it is secured thereto by strap 17. U-shaped members 73 are preferably pivotally attached to riser sections 62–63, etc. as seen in FIGS. 18 and 19, while the side-to-side pivoting of stand off member 74 allows overcoming of surface irregularities in the tree or other structure 11. Thus the stand off members can be pivoted vertically to deal with irregularities in the surface of a tree by placement thereof either above or below the vertical orientation as well as lateral adjustment provided by pivoting of member 74.

Figure 16:
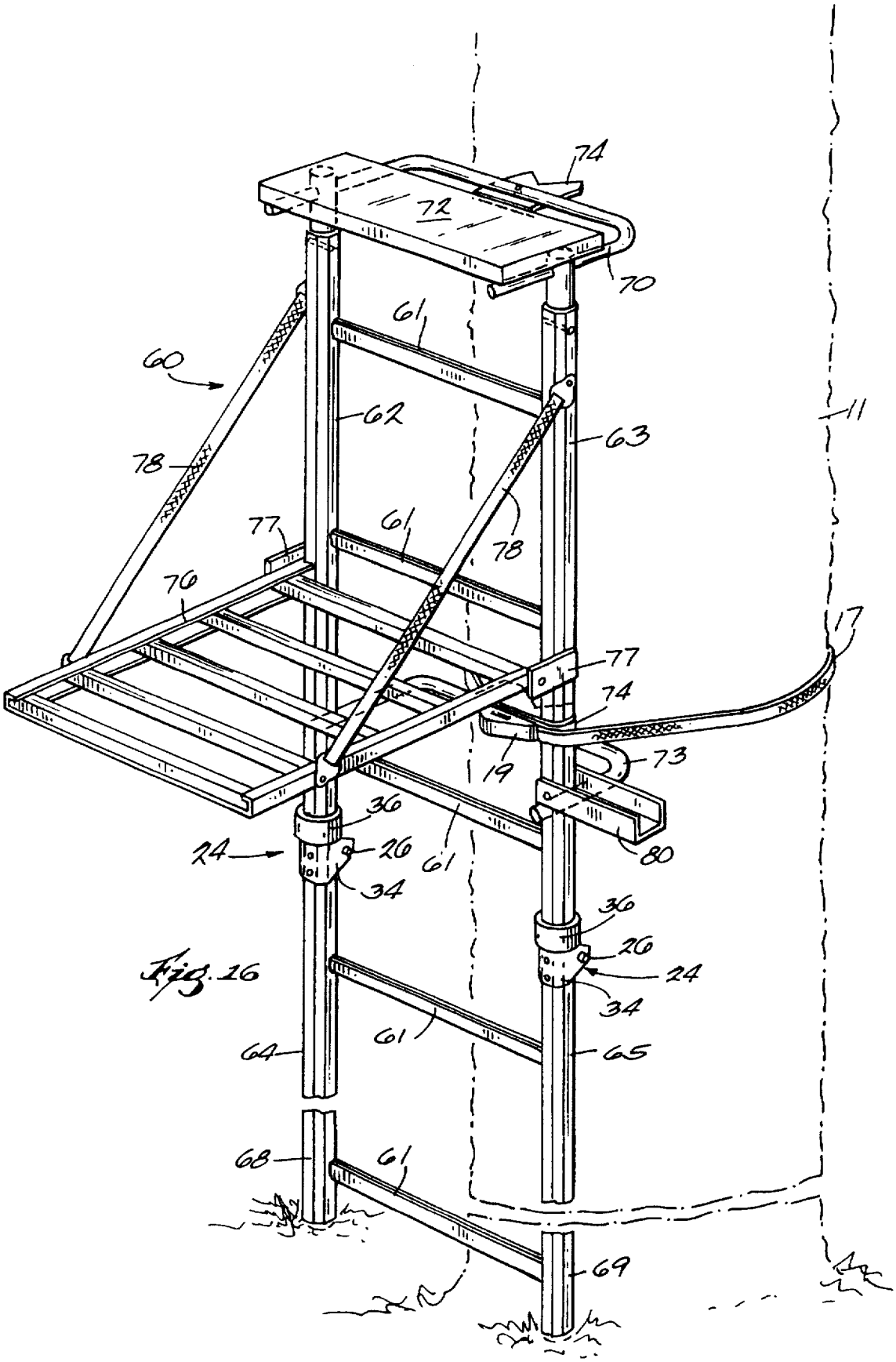
FIG. 16 is a perspective view of a two riser ladder in accordance with the invention secured to the trunk of a tree.
Figure 17:
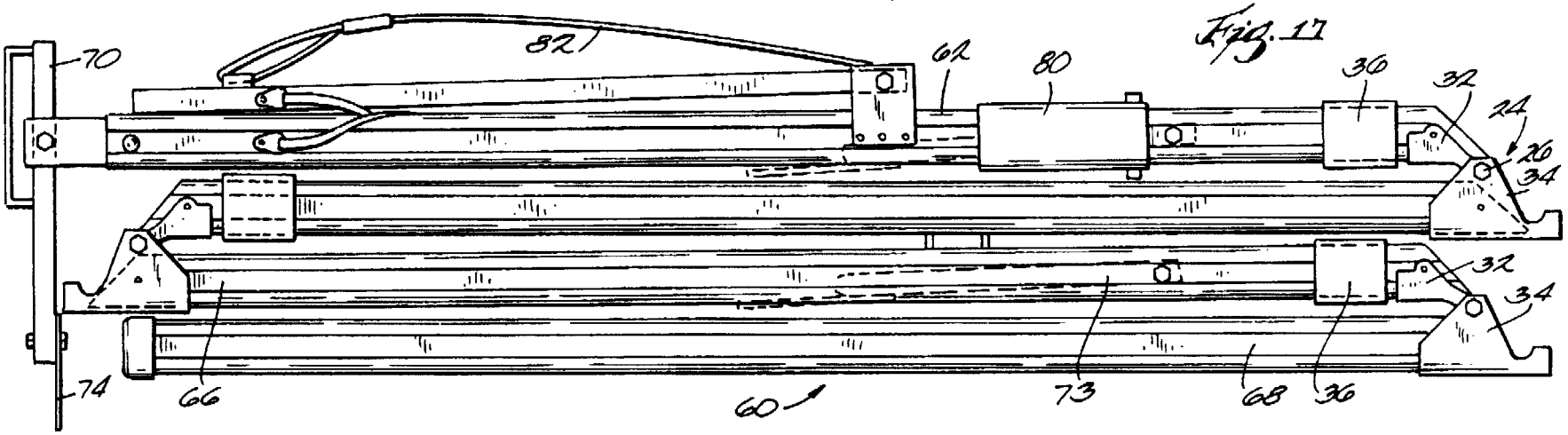
FIG. 17 is a side elevational view of the ladder of FIG. 16 folded into a compact position for transportation or storage.

A folding platform 76 for supporting a sportsman is pivotally attached to brackets 77 which may be welded to the sides of ladder riser components 62 and 63 as shown in FIG. 16. Straps 78 or similar supports are provided in order to position the platform 76 in the desired orientation. In order to provide safe access to the platform 76, it is preferred that a laterally extending cleat 80 be attached to one side or the other of the ladder riser components. Cleat 80 is pivotally attached to riser sections 62 or 63 as shown in the drawings. Alternative positions of cleat 80 are shown in FIGS. 16 and 17, respectively. Cleat 80 thus allows safe access to and from platform 76 from (and to) the ladder 60.

For ease of transportation of the ladder of FIGS. 16–19, it is preferred that shoulder straps 82 be provided. Using such shoulder straps, the ladder can be transported in the manner of a backpack.

While preferred embodiments of the invention have been described herein, it will be readily apparent to those skilled in the art that various modifications thereof can be made without departing from the spirit of the invention. Accordingly, the invention is to be limited only by the scope of the appended claims and equivalents thereof.

What is claimed is:

1. A belt and belt tightener mechanism combination for securing articles to structures comprising an elongated flat belt, a belt tightening member comprised of a pair of pivotally connected components, a first one of said components forming a base; the second one of said components being pivotable from a first position raised from said base to a second position adjacent said base;

means for releasably locking said components in their adjacent positions;

said pivoting component having integrally connected therewith a slotted pin;

a first end of said strap being looped through the slot of said pin and anchored to itself;

an opposite end of said belt being extendable around a structure and inserted into said slot whereby said pivoting component is pivoted from the open position to the closed position each end of said strap is pulled toward said mechanism by rotation of said slotted pin.

2. A combination according to claim 1 wherein said releasable locking means comprises a spring biased member on one of said components which is urged into engagement with a receiving member on the other of said components.

* * * * *